United States Patent [19]

Sakai et al.

[11] Patent Number: 4,955,253

[45] Date of Patent: Sep. 11, 1990

[54] SELF-LOCKING KNOB FOR ADJUSTABLE CONTROL MECHANISM

[75] Inventors: Yoshio Sakai, Ueda; Takeshi Yamada, Saku, both of Japan

[73] Assignees: HTC Co., Ltd; Totoku Electric Co., Ltd., both of Japan

[21] Appl. No.: 902,045

[22] Filed: Aug. 26, 1986

Related U.S. Application Data

[63] Continuation of Ser. No. 620,759, Jun. 14, 1984, abandoned.

[30] Foreign Application Priority Data

Apr. 28, 1984 [JP] Japan ..... 59-63648

[51] Int. Cl.[5] ..... G05G 1/10

[52] U.S. Cl. ..... 74/553; 74/531; 16/121; 16/DIG. 30

[58] Field of Search ..... 215/9, 216; 188/72.8; 74/553, 531, 527, 528; 292/354; 200/291, 323, 325, 11 J; 16/121, DIG. 30

[56] References Cited

U.S. PATENT DOCUMENTS

| | | | |
|---|---|---|---|
| 1,569,539 | 1/1926 | DesJardins | 74/553 |
| 1,597,067 | 8/1926 | Dienner | 74/553 |
| 2,068,693 | 1/1937 | Newell et al. | 74/553 |
| 2,881,867 | 4/1959 | Mayon | 188/72.8 |
| 3,612,323 | 10/1971 | Malick | 215/9 |
| 4,253,690 | 3/1981 | Hollander | 292/354 |
| 4,413,742 | 11/1983 | Sandhaus | 215/216 |
| 4,452,363 | 6/1984 | Davis | 215/216 |
| 4,455,886 | 6/1984 | Schmitt | 74/531 |
| 4,479,585 | 10/1984 | Sandhaus | 215/216 |

*Primary Examiner*—Vinh T. Luong

*Attorney, Agent, or Firm*—Wood, Phillips, Mason, Recktenwald & Vansanten

[57] ABSTRACT

A control mechanism having a dial and cooperating structure for selectively locking the dial in any one of a plurality of angularly related positions. The locking mechanism is configured to provide a force or manipulating characteristic precluding operation thereof by accident or by young children, such as infants, thereby effectively precluding undesired resetting of the associated control mechanism. The locking structure is formed integrally with the respective relatively movable parts of the mechanism, including the structure for providing the biasing of the locking mechanism to the locking disposition. The locking mechanism is resiliently biased and includes a graspable portion which when grasped to effect movement of the control overcomes the resilient biasing. The biasing structure automatically relocks the dial upon release of the graspable portion.

7 Claims, 1 Drawing Sheet

SELF-LOCKING KNOB FOR ADJUSTABLE CONTROL MECHANISM

This application is a continuation, 10/21/86 division, of application Ser. No. 620,759, filed June 14, 1985 abandoned

BACKGROUND OF THE INVENTION

1. Field of the Invention

This invention relates to adjustable controls and more specifically to means for preventing accidental or unauthorized readjustment thereof.

2. Description of the Background Art

It is conventional in control mechanisms to provide a manipulating element for manipulation by a user to effect adjustment of the control mechanism as desired. In one form of such control mechanism, the control is adjusted by rotation of a control shaft, with the shaft being rotated by means of a knob at the end thereof.

One example of such a control mechanism is a thermostat control mechanism, such as for use in domestic furnace control applications. In one form of such mechanism, a segmentally cylindrical knob is provided for rotation about an axis, with the rotation of the knob through its connection to the thermostat control effecting adjustment thereof for adjusted control of the operation of the furnace. It is conventional in such thermostatic controls to provide some frictional means for releasably retaining the control in the set position.

A modified form of such temperature regulation control is utilized in connection with waterbeds for regulating the means for heating the bed water to a desired temperature. Such controls are conventionally disposed adjacent the bed for facilitated adjustment by the user.

Because of the large heat sink characteristics of the large volume of water utilized in such waterbeds, a substantial amount of heat energy is required for raising the temperature of the water as desired by the user. It is conventional in such beds to adjust the temperature of the water to approximately room temperature, such as approximately 70° F. A small change in the setting of the thermostat affects a large amount of heat energy in providing a corresponding change in the temperature and, thus, it is desirable to prevent undesired changes in the thermostat settings, such as may be caused by accidental contact with the thermostat, or as by a child playing with or tampering with the setting. In most domestic applications, children have access to the thermostat control and a substantial problem has arisen in this regard in connection with the waterbed thermostat control mechanisms of the prior art.

SUMMARY OF THE INVENTION

The present invention comprehends an improved control mechanism for use with waterbeds and the like which effectively prevents undesired accidental or unauthorized resetting of the thermostat, while yet permitting facilitated setting of the thermostat by the normal, or authorized user.

The invention comprehends the provision of such a control mechanism wherein facilitated release of the control locking means and readjustment may be effected as by substantially conventional manipulation by the user.

In the illustrated embodiment, the control defines a graspable element, such as a knob, having a resiliently deflectible portion normally effecting a locking of the knob in a previously selected disposition. The invention further comprehends the arrangement of the deflectible portions such that manipulation of the knob in a grasping manner by the user may concurrently be utilized to effect a release of the locking function by suitable application of a force to the locking means in a grasping manner.

The force required to effect release of the locking means is preferably greater than that normally applicable by a young child or infant so that such a young person will not normally be able to effect repositioning of the knob. Similarly, the force is preselected to be sufficiently great so as to avoid inadvertent accidental resetting of the knob and control mechanism.

On the other hand, the force is preselected so as to permit facilitated release of the locking mechanism by the user when desired. In the illustrated embodiment, the locking force is controlled by the provision of slits in the flank or peripheral portion of the knob, with the intermediate knob portion being provided with teeth engageable with an array of teeth on an associated base portion of the control for selectively locking the knob in any one of a plurality of rotational positions about the rotational axis thereof by the cooperative engagement between the knob teeth and the base teeth over a preselected angular extent.

The invention comprehends the provision in a mechanism having an adjustable control and movable means for adjusting the control, an improved means for affording controlled movement of the movable means including manipulating means connected to the movable means and defining a graspable portion for effecting manual movement of the movable means, resiliently biased locking means associated with the manipulating means mechanism for locking the manipulating means against normal movement, and means responsive to grasping of the manipulating means with sufficient force to overcome the biasing of the locking means for concurrently releasing the locking means and permitting movement of the manipulating means to adjust the control, the locking means being biased to relock the manipulating means upon removal of the force with the control retained in the adjusted disposition.

In the illustrated embodiment, the manipulating means comprises a knob and the locking means comprises a yieldable integral portion thereof.

In the illustrated embodiment, the locking means comprises cooperating teeth on the knob and a base portion of the control mechanism concentric of the axis of rotation of the knob.

In the illustrated embodiment, the base portion is provided with an arcuate array of teeth cooperating with a smaller number of teeth on the knob and providing a range of locked positioning of the knob about its axis.

In the illustrated embodiment, the base teeth extend approximately 180° about the knob axis.

In the illustrated embodiment, the knob is provided with a pair of generally radially extending slots defining therebetween a resiliently integrally connected tooth-carrying portion which may be deflected against the biasing of the resiliency of the material of which the knob is formed by the user in the normal grasping operation.

Thus, the control provides means for concurrently releasing the locking means against the biasing action thereof and effecting desired repositioning movement of the knob in a substantially single manipulation action.

In broad aspect, the invention comprehends the provision of an improved temperature controlling system.

Further the invention comprehends the provision of an improved safety control device independent of the control mechanism.

Further the invention comprehends the provision of an improved locking mechanism for use in controlling relative positioning between two bodies.

The control mechanism of the present invention is extremely simple and economical of construction while yet providing the features and advantages discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
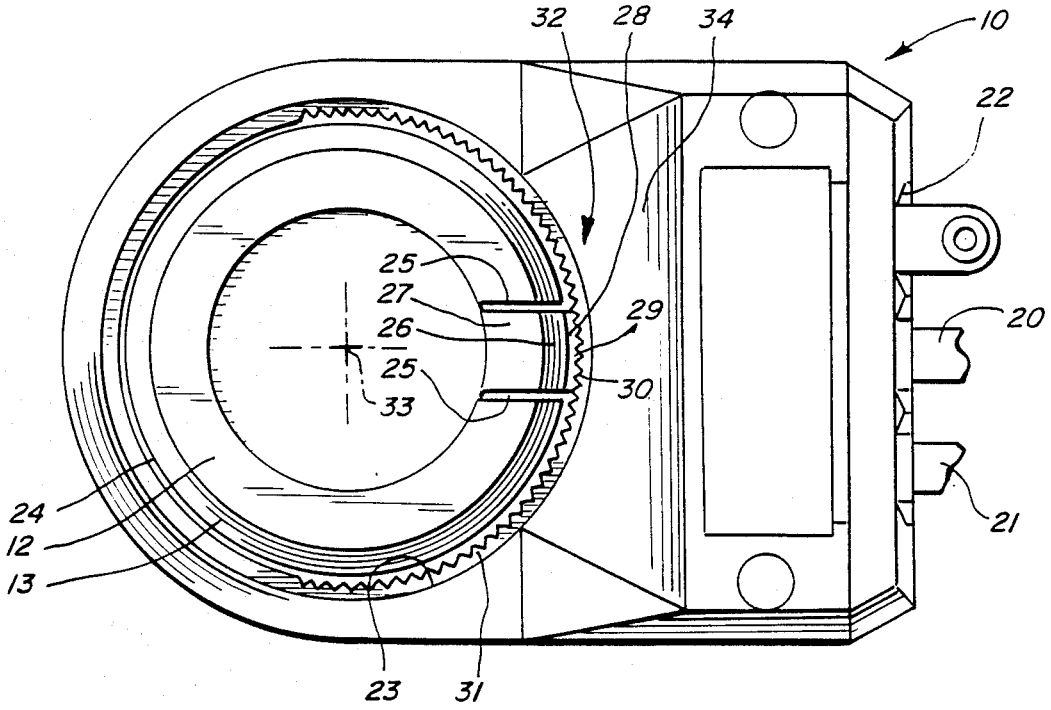
FIG. 1 is a plan view of a control mechanism embodying the invention, with portions broken away to facilitate illustration thereof.

In the exemplary embodiment of the invention as disclosed in the drawing, a control mechanism generally designated 10 includes a generally frustoconical dial generally designated 11, having a generally circular top wall portion 12 and a downwardly widening frustoconical peripheral portion 13.

Dial 11 effectively defines a control knob which is rotatably mounted to a control shaft 14 of a thermostatic control 15 mounted within a housing generally designated 16. The housing includes a lower portion 17 and an upper portion 18. Thus, the housing 16 defines a body with respect to which the knob, or dial, 11 is rotatably associated.

Electric power is provided to the control through a cord 20. A thermostat wire 21 is further connected to the control 15 for providing a sensed temperature signal thereto. The housing further defines an output plug 22 for connection of a water heater (not shown) to the thermostat control 15.

The invention is concerned with means for controlling the rotatable setting of the dial, or knob, 11 and, thus, the adjusted setting of the thermostat control 15. For this purpose, body portion 18 defines an upstanding annular wall 23 circumscribing a lowermost cylindrical extension 24 of the frustoconical wall 13 of the dial.

As shown in FIG. 1, the dial is provided with a pair of parallel, generally radially extending slots 25 extending upwardly through the cylindrical portion 24, the frustoconical portion 13, and partially into the circular portion 12 of the dial. Thus, the flank, or edge portion of thc dial defined between slots 25 comprises a tongue 26 having its upper end 27 integral with the dial portion 12 and its lower distal end 28 adjacent the upright wall 23.

The distal end 28 is provided with an outturned flange portion 29 defining a plurality of outwardly projecting teeth 30. In the illustrated embodiment, the teeth are triangular in section, as seen in FIG. 1, and complementary to inwardly projecting teeth 31 formed in the radially inner portion of the wall 23 over approximately 180° of the annular extent of the wall.

Thus, the cooperating teeth 30 and 31 define a releasable locking means 32 for retaining the dial 11 in any one of a plurality of different angular positions about the vertical axis 33 of the control mechanism shaft 14.

In the illustrated embodiment, the resiliency characteristics of the material of which the dial is made are coordinated with the length of the slots 25 to provide a preselected resistance to movement of the lower end 28 of the tongue 26 radially towards axis 33 for maintaining locking engagement of the teeth 30 of the tongue with the wall teeth 31, thereby maintaining the temperature setting of control thermostat 15. However, when it is desired to change the setting, the user merely grasps the frustoconical wall portion 13 with one or more fingers engaging the tongue 26, and by pressing radially inwardly against the tongue, disengage teeth 30 from teeth 31, thereby freeing the dial for rotational movement about axis 33 to a new desired setting of the thermostat control 15. As the dial is configured so as to conform to a normal adult user's hand, the grasping action automatically maintains the desired deflection of tongue 26 during concurrent rotation of the dial to the new desired setting whereupon discontinuation of the grasping action permits the tongue to return to its normal disposition wherein the teeth 30 are biased into engagement with teeth 31, thereby locking the dial 11 and control 15 in the newly selected adjusted position.

In the illustrated embodiment, the dial is formed of a molded synthetic resin. Similarly, the housing may be formed of molded synthetic resin and, thus, the teeth 30 and 31 may be formed economically by molding thereof.

Figure 2:
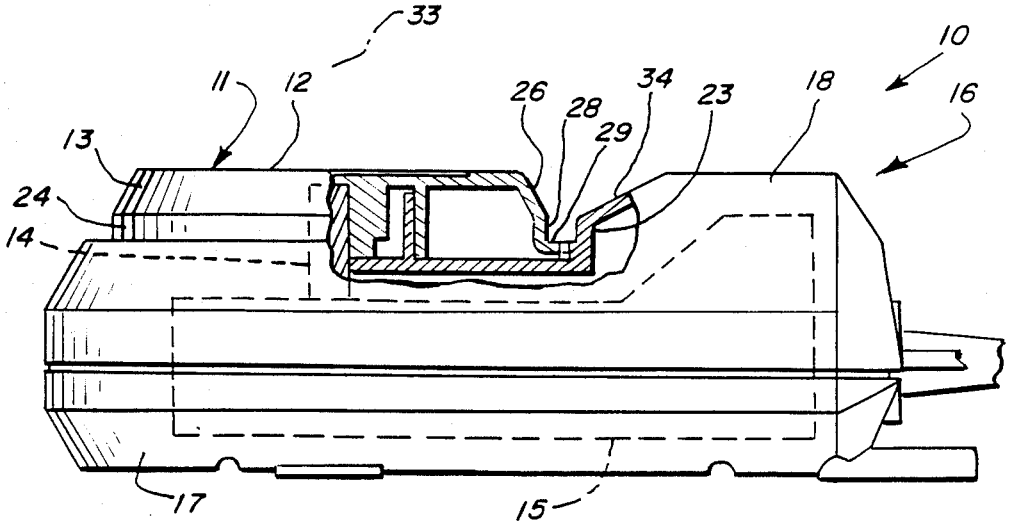
FIG. 2 is a side elevation with a portion shown in diametric section along line 2—2 of FIG. 1.

As seen in FIG. 2, the rear portion 34 of housing part 18 is raised and, thus, further protects tongue 26 from inadvertent engagement providing further improved prevention of accidental resetting of the thermostat over a substantial range of movement of the dial.

The locking means 32 is extremely simple and economical of construction while yet providing a positive means for preventing accidental resetting of the thermostat control or undesirable resetting by young children having insufficient strength to manipulate the tongue so as to effect the necessary unlocking operation. The invention comprehends that the locking means be formed integrally with the respective dial and housing means, thereby further effectively minimizing the cost of the control.

The control is adapted for use with a wide range of devices wherein a control dial is desirably maintained in preselected dispositions. Thus, the control system is adapted for use not only with waterbeds but also with electric blankets, electric carpets, electric water heaters, etc.

As the tongue is deflectible about its connection to the main body of the dial, the movement of teeth 30 may have components both radially of and parallel to shaft axis 33 in effecting the above discussed unlocking and relocking functions. By varying the spacing between the slots 25, control of the unlocking force required is provided. Similarly, such control may be effected by varying the thickness of the connection of the tongue to the main body of the dial.

In the illustrated embodiment, the tongue is provided with a plurality of teeth complementary in shape to the teeth of the annular wall. As will be obvious to those skilled in the art, other configurations may be utilized with the complementary locking elements effectively defining cooperating projection and aperture means within the scope of the invention.

As will be further obvious to those skilled in the art, the housing may be provided with a single projection and the dial provided with a plurality of recesses for selective cooperation therewith.

The foregoing disclosure of specific embodiments is illustrative of the broad inventive concepts comprehended by the invention.

We claim:

1. In a mechanism having an adjustable control, and movable means for adjusting the control, the improvement comprising:

manipulating means connected to said movable means and defining a graspable portion for effecting manual movement of said movable means;

resiliently outwardly biased locking means associated with said graspable portion of the manipulating means for locking said manipulating means against manual movement; and means responsive solely to grasping of said graspable portion of the manipulating means with sufficient inward grasping force to overcome the biasing of said locking means for concurrently releasing said locking means and permitting movement of said manipulating means to adjust said control, said biasing means comprising means for automatically relocking the manipulating means upon removal of said grasping force with the control retained in the adjusted disposition.

2. The mechanism of claim 1 wherein said manipulating means comprises a knob and said locking means comprises a yieldable integral portion of the knob.

3. The mechanism of claim 1 wherein said manipulating means comprises a knob and said locking means comprises a yieldable integral portion of the knob defining a movable locking element, and fixed cooperating means associated with said mechanism for selective engagement by said locking element.

4. The mechanism of claim 1 wherein said manipulating means comprises a knob and said locking means comprises a yieldable integral portion of the knob having a distal end defining a movable locking toothed element, and fixed cooperating toothed means associated with said mechanism for selective engagement by said locking toothed element.

5. The mechanism of claim 1 wherein said movable means comprises means rotatable about an axis, said manipulating means comprises a knob and said locking means comprises a yieldable integral portion of the knob having a distal end defining a movable locking toothed element, and fixed cooperating toothed means associated with said mechanism for selective engagement by said locking toothed element, said toothed elements defining teeth projecting radially of said axis.

6. The mechanism of claim 1 wherein said manipulating means comprises a knob and said locking means comprises a yieldable integral portion of the knob defined by spaced slits opening through an edge portion of the knob.

7. The mechanism of claim 1 wherein said movable means comprises means rotatable about an axis, and said manipulating means comprises a knob, said locking means comprises a yieldable integral portion of the knob defining a movable locking toothed element, and fixed cooperating toothed means associated with said mechanism for selective engagement by said locking toothed element, said toothed elements defining teeth projecting radially of said axis, and spaced radial slits in said knob at opposite sides of said movable locking toothed element.

* * * * *